United States Patent [19]

Kyte

[11] 4,025,106

[45] May 24, 1977

[54] COLLAPSIBLE CHAIR

[75] Inventor: Eric Kyte, Ilkley, England

[73] Assignee: Bulldog Toy Company Limited, Leeds, England

[22] Filed: Dec. 11, 1975

[21] Appl. No.: 639,736

[52] U.S. Cl. ..... 297/16; D6/12; 297/55

[51] Int. Cl.[2] ..... A47C 4/00

[58] Field of Search ..... 297/16, 18, 19, 51, 297/52, 53, 55, 23, 24, 25, 26, 56, 47, 59, 129; 248/164; 108/115, 112

[56] References Cited

UNITED STATES PATENTS

| | | | |
|---|---|---|---|
| 113,266 | 4/1871 | Crane | 108/118 |
| 468,612 | 2/1892 | Farley | 297/33 |
| 1,949,951 | 3/1934 | Bozarth | 297/56 X |
| 2,532,863 | 12/1950 | Taylor | 297/16 |
| 3,048,440 | 8/1962 | McPherson et al. | 297/33 |
| 3,236,387 | 2/1966 | Perini | 248/164 X |

*Primary Examiner*—Roy D. Frazier
*Assistant Examiner*—Peter A. Aschenbrenner
*Attorney, Agent, or Firm*—Fred Philpitt

[57] ABSTRACT

A collapsible item of furniture is made up of three or four panels, preferably flat panels of which two lie in crossed relationship in the erected condition of the chair to provide support for a deck panel and in the collapsed condition the panels hang one from another in the same plane. This enables the painting of the panels to define a decorative article which can be hung flat on a wall.

6 Claims, 7 Drawing Figures

COLLAPSIBLE CHAIR

This invention relates to a collapsible item of furniture and more especially to a collapsible chair for use by children.

According to the present invention there is provided a collapsible item of furniture comprising a deck member a first support member hinged to the deck member, a second support member hinged to the deck member, said second support member being capable of being arranged, when the item of furniture is in use in cross interlocking relationship relative to the first support so that the first and second support members act to support the deck member in a substantially horizontal disposition, the first and second support members being so hinged to the deck member that the item of furniture can be collapsed to a flat condition in which it can be held up so that the deck member hangs from the second support member and the first support member hangs from the deck member.

In a preferred form of the item of furniture a base member hinged to said first member so that with the item of furniture in collapsed flat condition hung on a wall the base member hangs from the first support member, said base member and second member being adapted to lockingly interengage in the in use position.

In another form of locking arrangement the second member is provided with at least one shoulder which is adapted to engage in a slot in the base member. It will, of course, be appreciated that locking of the first and second member and locking of base member and second member may be incorporated in the item of furniture.

The second member may include two spaced apart depending members which in the erected condition of the item of furniture extend down to the base member and which are adapted to be locked onto the base member and/or the first member. In the collapsed condition of the item of furniture these depending members extend along either side of the deck member.

In a preferred arrangement of the item of furniture, the pivotable movement provided by the hinge is such that, the first member pivots with respect to the base member in the same direction as the second member pivots relative to the deck member while the pivotable movement of the seat member relative to the first member is in the opposite direction.

The four members of the item of furniture may be shaped in any fashion to provide a decorative effect to the item in the collapsed condition. For instance, in one form the members are shaped so that in its collapsed condition the item provides the outline of a soldier. In such an arrangement the surfaces of the four members may be painted or otherwise decorated to portray the Figure of a soldier and said depending members conveniently define the soldier's arms. Further, at least one of the four members may be provided with an aperture to enable the collapsed item of furniture to be hung on a wall when in flat condition.

Illustrative embodiments of the invention will now be described with reference to the accompanying drawings in which:

FIG. 1 illustrates a view of a chair when in its collapsed condition and how it might appear when hanging on a wall;

FIGS. 2 and 3 respectively illustrate in side view and in perspective view the chair of FIG. 1 in its erected condition;

Figure 1:
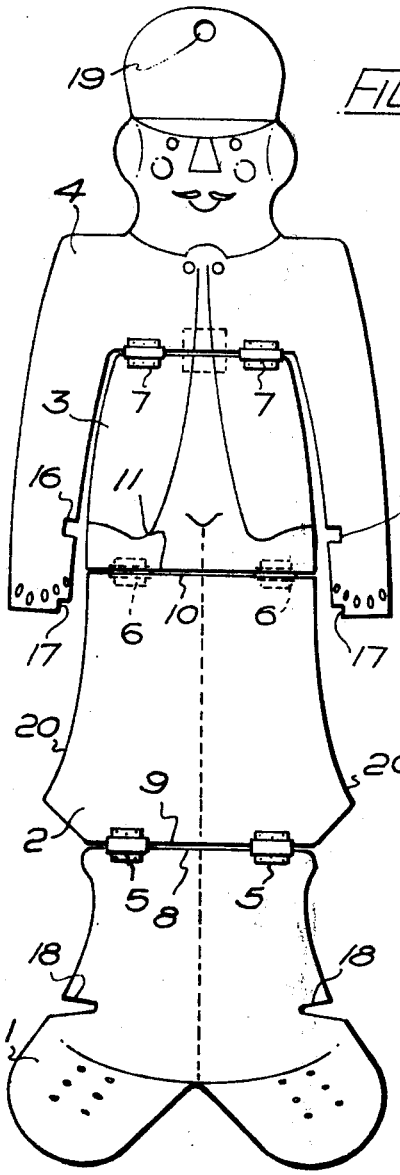
Figure 2:
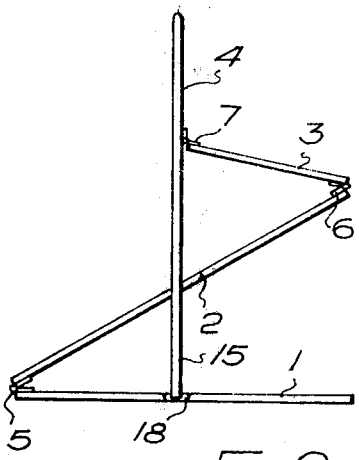
Figure 3:
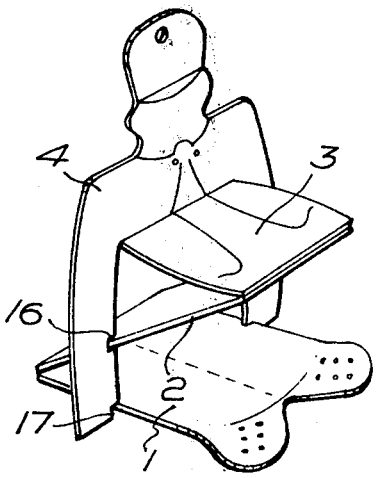

Referring now to FIGS. 1 to 3 of the drawings, there is shown a chair comprising a base member 1, a first support member 2, a seat member 3 and a second and back support member 4. The four members are all flat rigid panels and are shaped so that, as shown in FIG. 1, in its collapsed condition the chair represents the outline of a soldier and can be hung on a wall so that the members hang in sequence from one another. Further, one surface of each of the members has been painted, again as shown in FIG. 1, to portray a soldier.

The four members are connected together by means of pairs of hinges 5, 6 and 7. The hinges 5 are arranged between the edge 8 of the base member 1 and the edge 9 of the first member 2 so that the painted surfaces of the members 1 or 2 may be pivoted towards and away from each other. The hinges 6 shown in dotted lines in FIG. 1 are arranged between the edge 10 of the member 2 and the edge 11 of the member 3 so that the reverse or non-painted surface of the members 2 and 3 may be pivoted towards and away from each other. Finally the hinges 7 are arranged between the edge 12 of the member 3 and the edge 13 of the member 4 to allow the painted surfaces of the members 3 and 4 to be pivoted towards and away from each other.

As can best be seen from FIG. 1, the second member 4 is provided with two depending arms 14, 15 which extend beyond the member 3 in the flat condition of the chair. Each of the arms is provided with a slot 16 and a shoulder 17. Further the base member 1 is provided with a pair of slots 18. The slots 16 and 18 and the shoulders 17 provide the locking arrangement for the chair as will be described. The second member 4 is also provided with an aperture 19 to enable the chair in the flat condition shown to be hung on a suitable attachment on a wall, with the non-painted side of the chair nearest the wall, and so that member 3 hangs from member 4, member 2 hangs from member 3, and member 1 hangs from member 2. In the collapsed condition, this non-painted side provides a substantially flat surface.

To erect the chair the four members are pivoted into the configuration shown in FIGS. 2 and 3 in which members 4 and 2 are crossed relationship. The chair is locked in its erected position by the flared edge portions 20, 21 of the member 2 engaging in the slots 16 of the arm 14 and 15 and the shoulder 17 of the arms engaging in the slots 18 of the base member 1. In its erected position the base member 1 is arranged so that it can conveniently rest upon the floor of a room and has a decorative and novel appearance as shown in FIG. 3.

Figure 4:
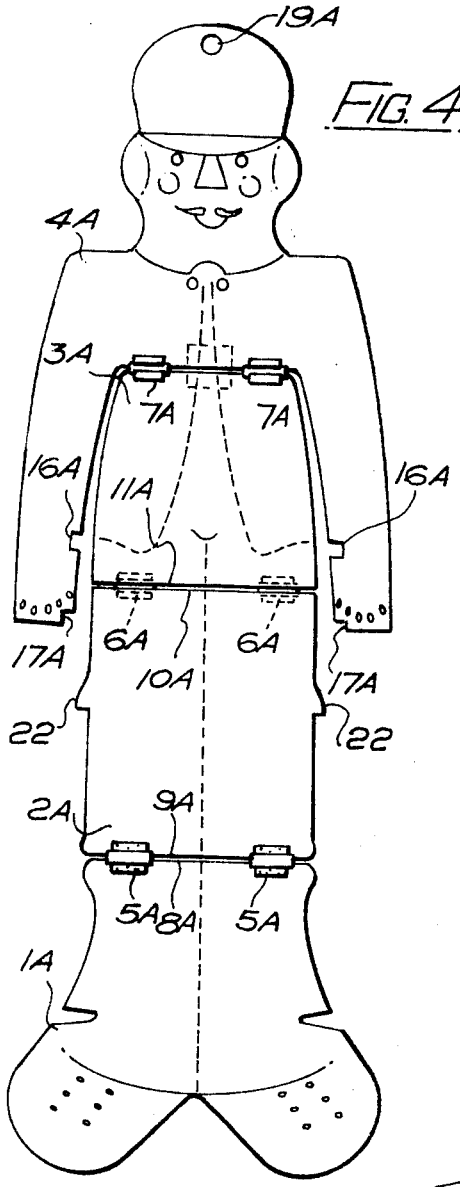
FIG. 4 is a view similar to FIG. 1 but showing another embodiment of the invention.

The embodiment of the invention shown in FIG. 4 is basically the same as that shown in FIGS. 1 to 3 and parts already described in relationship to the FIGS. 1 to 3 embodiment have the same reference number with the suffix 'A'. The basic difference between the FIG. 4 embodiment and the FIGS. 1 to 3 embodiment is that the flared portions 20 of first support member 2A are omitted and instead the member 2A is provided with shoulders 22 which is the erected condition of the chair (i.e. as shown in FIGS. 2 and 3) the shoulders bear upon the painted front surfaces of the arms of member 4. This has the effect of making the chair more stable in use.

Figure 5:
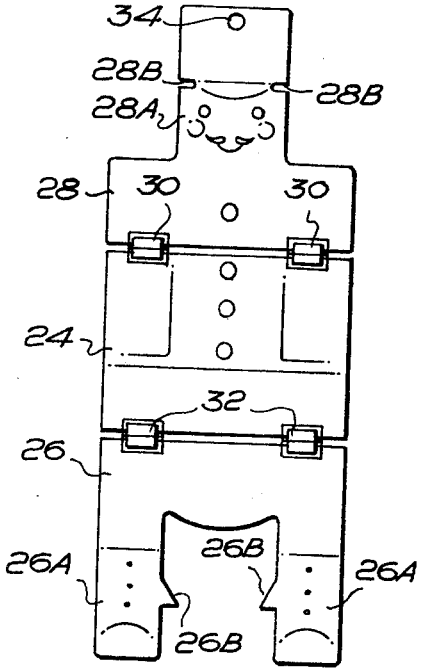
FIG. 5 is a view of a chair or table of another embodiment of the invention, the view being similar to FIGS. 1 and 4.
Figure 6:
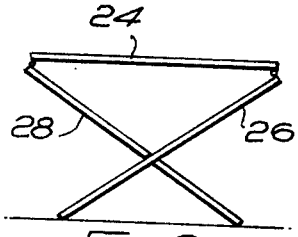
FIGS. 6 and 7 respectively illustrate in side view and in perspective view the items of furniture of FIG. 5 in the erected condition.
Figure 7:
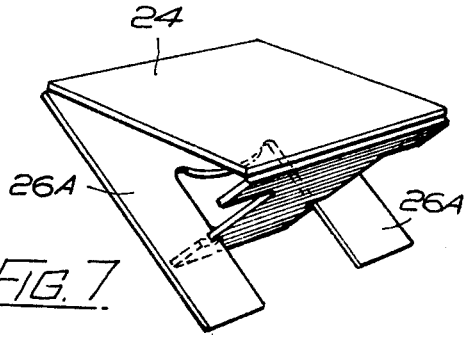

Referring to FIGS. 5, 6 and 7, the item shown can be used as a table or a chair and is generally similar in construction and materials to the items illustrated in FIGS. 1 and 4. The item comprises three flat panels namely in deck panel 24, a first support panel 26 and a second support panel 26 and a second support panel 28. The panels 24, 26 and 28 are connected by hinges 30, 32 so that in the collapsed condition, the item can be hung on a wall, panel 28 having an aperture 34 for this purpose, so that the panels lie in a common plane with panel 24 hanging from panel 28, and panel 26 hanging from panel 24. The panels are decorated so that they together represent a toy soldier as shown. To erect a table or chair as shown in FIGS. 6 and 7, the panels 26 and 28 are hinged in opposite direction relative to panel 24 so that leg portion 28A lies between and interlocks with leg portions 26A of panel 26. To this end, leg portions 26A have shoulders 26B which bear on portion 28A and the edges of portions 26A engage in slots 28B in leg portion 28A, in the erected condition of the item. This ensures that the portions 26A and 28A lock together firmly to support loading on the deck panel 24. The item can easily be erected and collapsed at will.

The item of furniture according to the invention is ideal for children. In the collapsed state not only does it take up very little space, but it is also usable as a wall decoration. Furthermore, where the item is decorated in the fashion of a soldier as shown in the erected condition of the train of FIGS. 1 to 4 the soldier appears in a squatting position, and quite lifelike, whilst in the flat condition and with the collapsed chair hung on a wall the soldier appears to be standing as if he were on guard duty, making the chair a very useful and enjoyable article for children.

The chair of either embodiment may be made from any suitable material, for instance wood and the four members may be shaped into any desired shape. Further, the surfaces of the four members may have any suitable design thereon.

I claim:

1. A collapsible chair comprising hingedly interconnected flat sheet members comprising a seat member, a combined back rest and leg support member, and a second leg support member, said combined back rest and leg support member and second leg support member being hinged to opposite edges of the seat member, and said combined member having a back rest portion and spaced leg support portions which lie on opposite sides of the axis of the hinging between the seat member and the combined member, said leg portions being adapted to engage in cross interlocking fashion with the second leg support member supporting the seat member in substantially horizontal disposition with the back rest portion extending upwardly from the seat member, said chair being capable of being hung on a wall by the combined member so that the combined member, seat member and second support member lie in a common flat plane and can constitute a flat, decorative wall article with the said leg portions of the composite member extending down the sides of the seat member.

2. A collapsible chair according to claim 1, including a base member hinged to said second leg member at the opposite side to which the seat member is hinged so that with the item of furniture in collapsed flat condition hung on a wall, the base member hangs from the bottom of the second support member and with the same plane as the other members, said base member and the end of the second leg portions of the combined member being adapted to lockingly interengage in the in use position.

3. A collapsible chair according to claim 2 wherein said base member has slots in which projections at the ends of said leg portions engage to provide said locking interengagement.

4. A collapsible chair according to claim 1 wherein the leg support portions have slots in which the second leg support member engages and the leg support member has shoulders which bear on the leg support portions to provide said interlocking of the leg support portions and the second leg member.

5. A collapsible chair according to claim 1 wherein the back rest portion has a suspension hole for hanging the item of furniture in collapsed condition on a wall.

6. A collapsible chair according to claim 1, wherein the flat chair members are decorated so that together when in the flat condition and hung from a wall they jointly depict the figure of a person standing upright, the said leg support portions defining the arms of the person, and also depict a person in a sitting position when the chair is in the erected condition.

* * * * *